United States Patent [19]

Graham

[11] 4,313,497

[45] Feb. 2, 1982

[54] PRESSURE CONTROL VALVE

[76] Inventor: Rickey T. Graham, P.O. Box 1239, Bruceville, Tex. 76630

[21] Appl. No.: 131,550

[22] Filed: Mar. 18, 1980

[51] Int. Cl.[3] ..... E21B 23/06

[52] U.S. Cl. ..... 166/124; 166/133; 166/217; 166/330

[58] Field of Search ..... 166/133, 217, 330, 124

[56] References Cited

U.S. PATENT DOCUMENTS

| | | | |
|---|---|---|---|
| 2,178,999 | 11/1935 | Scoh | 166/124 |
| 2,305,062 | 12/1942 | Church et al. | 166/124 |
| 2,696,886 | 5/1954 | Ware | 166/124 |

*Primary Examiner*—William F. Pate, III

*Attorney, Agent, or Firm*—Harvey B. Jacobson

[57] ABSTRACT

An upstanding valve body assembly is provided defining a center axis and includes radially expandable and retractable slips. The assembly includes a slip actuator rotatable relative to the remainder of the assembly about the center axis for expansion and retraction of the slips responsive to rotation of the slip actuator in opposite directions. A suspension member projects above the actuator and is threadedly engaged therewith for threaded shifting relative thereto along the axis. The suspension member is threadedly disengageable and engageable with the actuator portion upon rotation relative thereto in first and second directions, respectively. The actuator portion is operative to expand and contract the slips upon rotation thereof relative to the remainder of the body assembly in the first and second directions, respectively, and the actuator portion and suspension member include abutment portions engageable with each other to limit threaded engagement of the suspension member with said actuator portion in a manner to releasably frictionally jam the suspension member against its rotation relative to the actuator portion responsive to rotation of the actuator portion in said second direction. The body assembly defines an axial passage therethrough including an axially shiftable valve member for opening and closing the passage, the valve member being biased to the closed position, and the actuator portion and valve member include coacting structure for moving the valve member to its open position upon final movement of the actuator portion toward the jammed position relative to the actuator portion.

10 Claims, 3 Drawing Figures

PRESSURE CONTROL VALVE

BACKGROUND OF THE INVENTION

During various well drilling operations, it is desirable to close off the upper end of a well casing from downhole pressures, such as when it is desirable to effect repairs to or modifications of the tree at the top of the well casing.

While there are various tools which may accomplish the desired function, most of these are placed within the well casing through the utilization of a wire line and are not only sometimes difficult to properly install but also sometimes impossible to remove as desired requiring that their removal be effected by fishing or milling operations. Accordingly, a need exists for a means by which downhole pressure may be controlled in an effective manner through the utilization of an apparatus which may be readily inserted downwardly in the casing and removed therefrom whenever desired.

BRIEF DESCRIPTION OF THE INVENTION

The pressure control valve of the instant invention includes a body which may be utilized in lieu of a back pressure valve and may be lowered into a well casing through the utilization of a lubricator rod and also readily removed from the well casing by the use of a lubricator rod. The pressure control valve includes a suspension member for support from a lubricator rod and which is threadedly engaged with the body of the pressure control valve. The body of the valve includes expansion slips which may be expanded into anchoring position upon rotation of the suspension member in one direction and after the slips have been expanded continued rotation of the suspension member in the same direction affects unthreading action of the suspension member relative to the body of the pressure control valve. Threaded engagement of the suspension in the other direction toward a full threaded engagement with the body of the control valve and continued rotation of the suspension member thereafter in the same direction effects retraction of the slips of the control valve. In this manner, the control valve may be readily downwardly inserted into a well casing through the utilization of a lubricator rod and have its slips actuated for tight engagement with the well casing after which the suspension member for the control valve and the lubricator rod from with the suspension member is supported may be disengaged from the control valve and withdrawn from the upper end of the well casing. When it is desired to remove the control valve from the well casing, the suspension member is lowered back into the upper end of the well casing and rotated in a direction to threadedly engage the suspension member with the body portion. Thereafter, continued rotation of the suspension member in the same direction after full engagement thereof with the body of the valve, effects retraction of the slips of the control valve and thereby releasing the same for upward withdrawal from the well casing by the lubricator rod.

The main object of this invention is to provide a control valve which may be readily placed in position within the upper portion of a well casing and quickly secured in operative position.

Yet another object of this invention is to provide a control valve in accordance with the preceding objects and constructed in a manner whereby its removal through the utilization of a lubricator rod may be readily effected.

Still another object of this invention is to provide a control valve including a vertical passage extending therethrough and a valve member shiftable into and out of position closing the passage.

A further important object of this invention is to provide a control valve whose valve member will be maintained in the open position during insertion of the control valve into the upper end of the well casing and whose control valve will be automatically closed upon removal of the associated lubricator rod and suspension member subsequent to actuation of the slips of the control valve to anchor the valve in the well casing.

Another very important object of this invention is to provide a control valve including a valve member which will automatically be shifted toward the open position upon coupling of the associated lubricator rod and the suspension member with the control valve assembly preparatory to removal of the control valve from an associated well casing.

A final object of this invention to be specifically enumerated herein is to provide a control valve in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
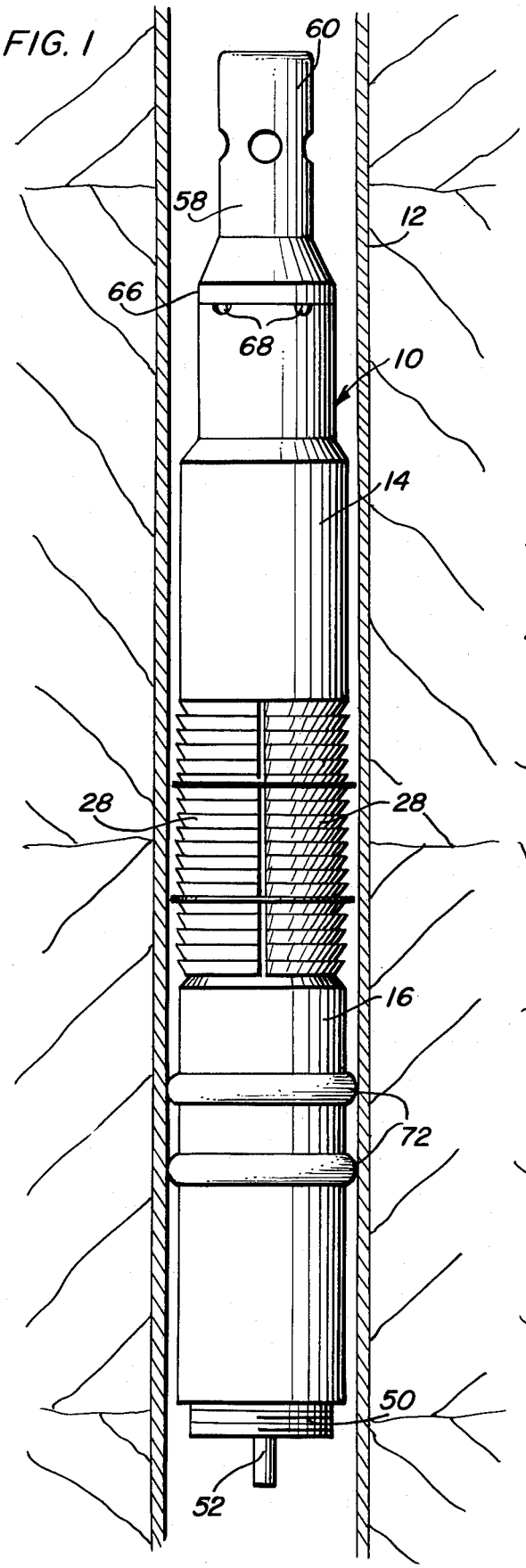
FIG. 1 is a fragmentary vertical sectional view of a portion of a well casing with the control valve of the instant invention illustrated in position within the casing prior to actuation of the slips thereof to secure the valve in the desired position within the casing.
Figure 2:
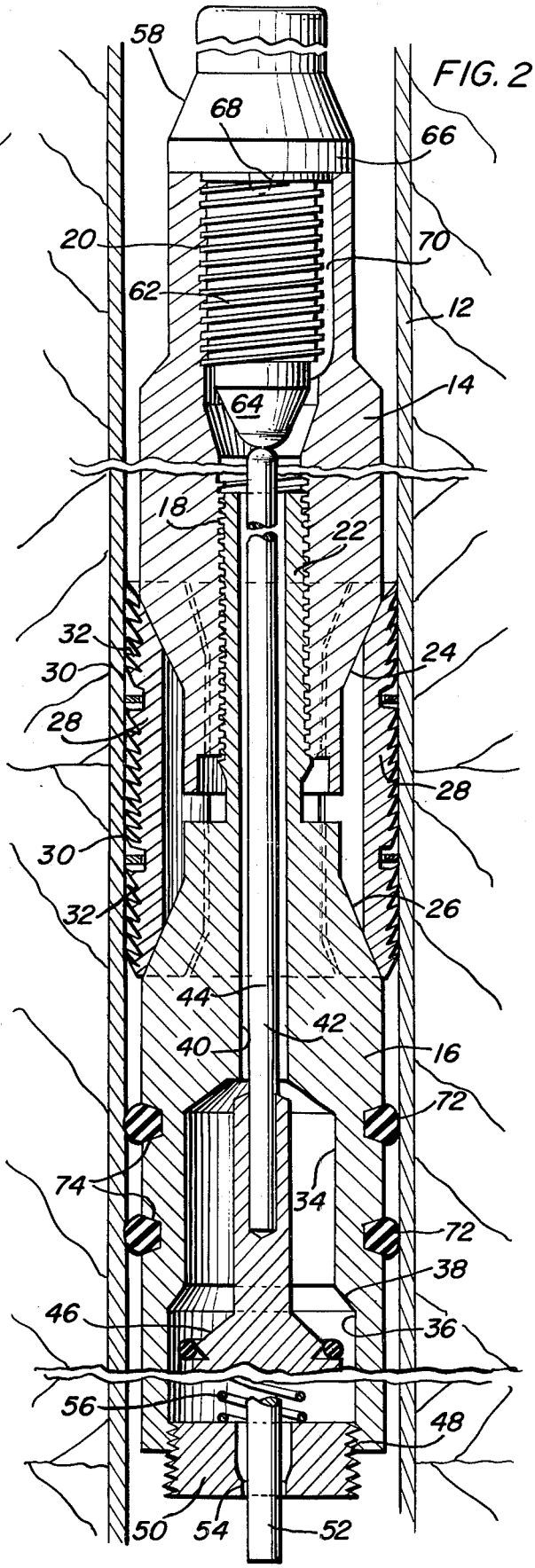
FIG. 2 is a fragmentary enlarged vertical sectional view illustrating the control valve tightly secured in the desired position within the associated well casing and with the valve member of the controlled valve in the open position.
Figure 3:
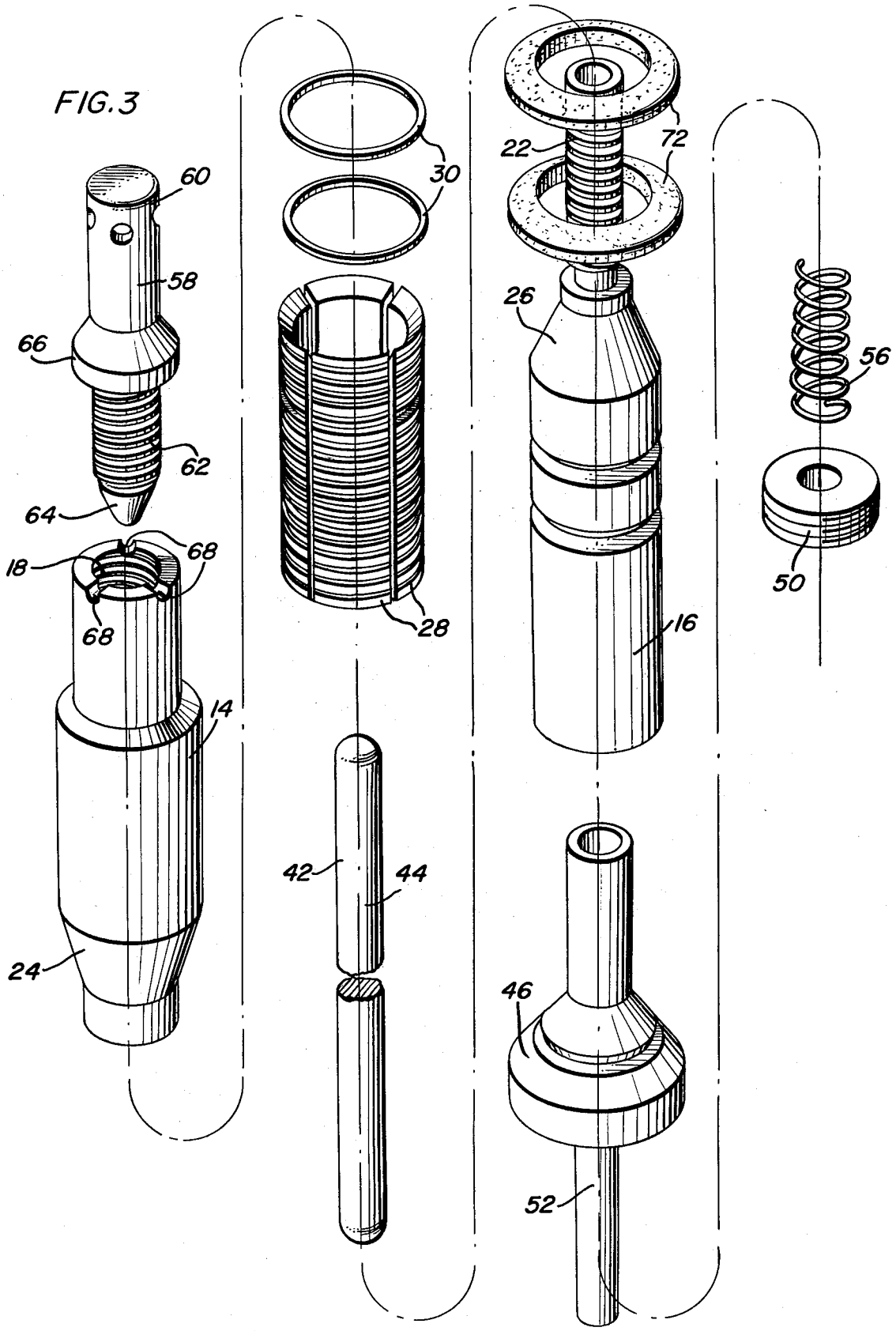
FIG. 3 is an exploded perspective view of the control valve.

Referring now more specifically to the drawings, the numeral 10 generally designates the pressure control valve of the instant invention. The valve 10 is illustrated in FIGS. 1 and 2 of the drawings as disposed within a well casing 12 and the valve 10 includes upper and lower tubular bodies 14 and 16.

The lower end of the upper tubular body 14 includes a left-hand threaded lower central bore portion 18 and the upper end of the tubular body 14 defines a right-hand threaded upper central bore portion 20. The upper end of the tubular body 16 includes an externally threaded tubular extension 22 removably threadedly engaged within the central bore portion 18 and the bodies 14 and 16 include downwardly and upwardly tapering conical wedge surfaces 24 and 26.

Four substantially quarter cylindrical slips 28 are disposed about the adjacent ends of the bodies 14 and 16 with the upper and lower ends of the slips 28 registered with the conical wedge surfaces 14 and 16. A pair of expandable slip retaining and retracting rings 30 extend about the slips 28 and are seated within grooves 32 formed in the slips and the lower end of the tubular body 16 includes first and second inner and outer counterbores 34 and 36, a conical valve seat 38 being defined between the counterbores 34 and 36.

The counterbores 34 and 36, the central bore 40 extending through the upper portion of the tubular body 16 and the extension 22 coact with the central bore portion 20 to form a continuous axial passage through the control valve 10. An elongated valve member 42 is provided including an elongated shank 44 closely received in the central bore 40 and a diametrically enlarged and O-ring equipped head 46 on the lower end of the shank 44. The head 46 is loosely receivable within the counterbore 36 and the O-ring equipped head 46 is upwardly displaceable into seated engagement with the seat 38.

The lower end of the counterbore 36 is threaded as at 48 and has a centrally apertured adjusting plug 50 threadedly engaged therein. The head 46 includes the depending shank 52 which projects through the central aperture 54 formed in the head 50 and a compression spring 56 is disposed about the shank 52 between the plug 50 and the head 46 and yieldingly biases the latter upwardly into seated engagement with the seat 38.

A suspension member 58 is provided and includes an upper end portion 60 for attachment to a lubricator rod (not shown) and an externally threaded lower end portion 62 terminating downwardly in a tapered point 64. The lower end portion 62 is threadedly engaged in the central bore portion 20 and the upper end portion 60 includes an enlarged portion 66 downwardly abuttingly engageable with the upper end face of the tubular body 14 in order to jam the threads on the lower end portion 62 and the threads in the central bore portion 20 against each other. The upper end of the tubular body 14 abutting against the underside of the enlarged portion 66 includes a plurality of upwardly opening radial grooves 68 communicating the exterior surface of the body 14 with the interior of the upper end of the body 14. Also, the portion of the tubular body 14 in which the central bore portion 20 is formed includes at least one longitudinal groove 70 formed therein communicating the upper end of the tubular extension 22 with the radial grooves 68 and therefore the exterior of the body 14 above O-ring seals 72 carried by the lower body 16.

In operation, the upper end portion 60 of the suspension member is coupled to the lower end of a lubricator rod (not shown) against rotation relative to the rod. Then with the suspension member 58 fully threadedly engaged with the tubular body 14 in the manner illustrated in FIG. 2 and with the enlarged portion 66 abutted tightly against the upper end of the tubular body 14 and the tapered point 64 engaged with and downwardly displacing the valve member 42 against the biasing action of the spring 56 to the open position, the control valve 10 is lowered into the casing 12 with the slips 28 in the retracted positions thereof illustrated in FIG. 1 of the drawings. Thereafter, the lubricator rod is rotated in a left-hand direction and, inasmuch as the suspension member 58 is jammed relative to the tubular body 14 against rotation relative thereto, rotation of the lubricator rod in the left-hand direction causes the tubular body 14 to be threaded downwardly upon the extension 22 and the slips 28 to be expanded tightly against the inner surface of the casing 12. At this point, the control valve 10 is securely anchored within the casing 12 and the passage extending therethrough is maintained open, the O-ring seals 72 carried in the grooves 74 formed in the lower portion of the tubular body 14 establishing a fluid tight seal between the casing 12 and the exterior surface of the tubular body 16.

Then, upon the application of increased torque to turn the suspension member 58 to the left, the right-hand threaded lower end portion 62 of the suspension member 58 will be loosened relative to the tubular body 14 and threaded upwardly from the central bore portion 24. Before the lower end portion 62 is completely unthreaded from the central bore portion 20, the tapered point 64 moves upwardly sufficient to enable the spring 56 to upwardly bias the head 46 to the closed position thereof in tightly sealed engagement with the seat 38. Of course, continued left-hand rotation of the suspension member 58 completely disconnects the suspension member 58 from the tubular body 14 and enables the lubricator rod and suspension member 58 to be withdrawn from the upper portion of the casing 12. The control valve 10 is now in the closed position sealing the downhole pressure of the casing 12 from the upper terminal end of the casing. Of course, suitable repairs to or modification of the tree at the well head may be made.

After the repairs or modification to the well head tree have been made, the lubricator rod with the suspension member 58 supported therefrom is again lowered into the casing 12 and turned in a right-hand direction. As the tapered point 64 enters the central bore portion 20 and is lowered therein, the threads on the lower end portion 62 wlll engage te thread of the central bore portion 20 and the suspension member 58 will become threadedly engaged with the tubular body 14. As the lower end portion 62 is threaded downwardly into the central bore portion 20, the tapered point 64 will again downwardly depress the valve member 42 and urge the latter toward its lower open position against the biasing action of the spring 56. As the enlarged portion 66 of the suspension member 58 abuts against the upper end of the tubular body 14, relative rotation between the suspension member 58 and the tubular body 14 will be terminated and continued right-hand rotation of the lubricator rod and suspension member 58 will effect right-hand rotation of the tubular body 14 relative to the tubular body 16 thus upwardly threading the tubular body 14 on the extension 22 and releasing the slips 28 from their outwardly expanded positions. This, of course, will enable the rings 30 to contract the slips 28 and the control valve 10 will be free to be raised upwardly within the well casing 12 by the lubricator rod from which the control valve 10 is suspended.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pressure control valve including upper and lower tubular bodies each including upper and lower ends, the lower and upper ends of said upper and lower bodies, respectively, including axially spaced downwardly and upwardly tapering outer conical wedge surface portions, a plurality of wedge surface equipped slips spaced about said wedge surface portions and expandable and retractable radially of said bodies upon movement of said bodies toward and away from each other, one of said bodies including an externally threaded tubular extension projecting toward and threaded into the adjacent end of the other body, said lower body defining a downward facing valve seat, a valve member including an upstanding shank and an enlarged head on the lower end of said shank, said valve member being reciprocally received in said lower member with said head opposing and upwardly displaceable against said seat and said shank projecting upwardly through said seat, said lower body, said tubular extension and into said upper body, means connected between said lower body and valve member yieldingly biasing the latter upwardly relatively to said seat, and a suspension member removably threaded into the upper end of said upper body, the threads on said upper body and suspension member being opposite to the threads on said extension and other body, and said suspension member being threadedly advanceable into said upper body to engage and downwardly depress said stem and thus open said valve member.

2. The combination of claim 1 wherein said threads on said suspension member and the mating threads on said upper body are right-hand threads and the threads on said extension and the mating threads on said other body are left-hand threads.

3. The combination of claim 2 wherein said upper body comprises said other body and said lower body comprises said one body.

4. The combination of claim 1 wherein said suspension member and upper and lower bodies include means defining a fluid flow path therethrough when said head is displaced from said seat.

5. The combination of claim 1 wherein said suspension member and upper body include abutment surface portions engageable with each other to limit threaded penetration of said suspension member into said upper body, said abutment surface portions being contoured to function in conjunction with the threads on suspension member and the mating threads in said upper body to frictionally jam said suspension member against free unthreading movement relative to said upper body.

6. A pressure control valve for insertion downwardly into a well casing, said valve including an upstanding body assembly defining an upstanding center axis, peripherally spaced slips expandable and retractable, at least generally radially of said axis, relative to said body assembly, said assembly including a slip actuator portion for said slips rotatable relative to the remainder of said body assembly about said axis and operative to expand and retract said slips responsive to rotation in opposite directions, a suspension member projecting above said actuator portion and threadedly engaged with the latter for threaded shifting relative thereto along said axis, said suspension member being threadedly disengageable from and engageable with said actuator portion upon rotation relative thereto in first and second directions, relatively, said actuator portion being operative to expand and contract said slips upon rotation thereof relative to said remainder of said body assembly in said first and second directions respectively, and said actuator portion and suspension member including abutment portions engageable with each other to limit threaded engagement with said suspension member with said actuator portion in a manner to releasably frictionally jam said suspension member against its rotation relative to said actuator portion responsive to rotation of the actuator portion in the second direction.

7. The combination of claim 6 wherein said body assembly defines an axial passage therethrough including a downwardly opening valve seat, a valve member including an upstanding shank having a lower end head, said shank being loosely reciprocal in said passage between a lowered open position with said head spaced below said seat and a raised closed position with said head seated against said seat, means yieldingly upwardly biasing said valve member relative to said body assembly, said suspension member including a portion engageable with said shank to downwardly displace the valve member from said upper closed position toward said lower open position responsive to final threaded movement of said suspension member toward jammed position relative to said actuator portion.

8. The combination of claim 7 wherein said actuator portion is threadedly supported from said remainder of said body assembly.

9. The combination of claim 8 wherein the threaded engagement of said actuator portion relative to said remainder of said body assembly includes left-hand threads and the threaded connection between said suspension member and said actuator portion includes right-hand threads.

10. A pressure control valve for insertion downwardly into a well casing, said valve including an upstanding body assembly defining an upstanding center axis, peripherally spaced slips expandable and retractable, at least generally radially of said axis, relative to said body assembly, said assembly including a slip actuator portion for said slips rotatable relative to the remainder of said body assembly about said axis and operative to expand and retract said slips responsive to rotation in opposite directions, a suspension member projecting above said actuator portion and threadedly engaged with the latter for threaded shifting relative thereto along said axis, said suspension member being threadedly disengageable from and engageable with said actuator portion upon rotation relative thereto in first and second directions, relatively, said actuator portion being operative to expand and contract said slips upon rotation thereof relative to said remainder of said body assembly in said first and second directions respectively, and said actuator portion and suspension member including abutment portions engageable with each other to limit threaded engagement with said suspension member with said actuator portion in a manner to releasably frictionally jam said suspension member against its rotation relative to said actuator portion responsive to rotation of the actuator portion in the second direction, said body assembly defining an axial passage extending therethrough, valve means in said passage shiftable between open and closed positions, said valve means and suspension member including means operative to open said valve means responsive to rotation of said suspension member relative to said actuator portion in said second direction to its limit position of rotation and to close said valve means responsive to rotation of said suspension member relative to said actuator portion in said first direction from said limit position.

* * * * *